US009899143B2

(12) United States Patent
Kim et al.

(10) Patent No.: US 9,899,143 B2
(45) Date of Patent: Feb. 20, 2018

(54) CHIP ELECTRONIC COMPONENT AND MANUFACTURING METHOD THEREOF

(71) Applicant: SAMSUNG ELECTRO-MECHANICS CO., LTD., Suwon-si, Gyeonggi-do (KR)

(72) Inventors: Sung Hee Kim, Suwon-si (KR); Tae Young Kim, Suwon-si (KR); Myoung Soon Park, Suwon-si (KR); Sung Hyun Kim, Suwon-si (KR); Hye Yeon Cha, Suwon-si (KR)

(73) Assignee: SAMSUNG ELECTRO-MECHANICS CO., LTD., Suwon-si, Gyeonggi-do (KR)

( * ) Notice: Subject to any disclaimer, the term of this patent is extended or adjusted under 35 U.S.C. 154(b) by 0 days.

(21) Appl. No.: 15/339,622

(22) Filed: Oct. 31, 2016

(65) Prior Publication Data

US 2017/0047160 A1 Feb. 16, 2017

Related U.S. Application Data

(63) Continuation of application No. 14/475,000, filed on Sep. 2, 2014, now abandoned.

(30) Foreign Application Priority Data

Dec. 4, 2013 (KR) ..... 10-2013-0150171

(51) Int. Cl.
*H01F 5/00* (2006.01)
*H01F 27/28* (2006.01)
(Continued)

(52) U.S. Cl.
CPC ..... *H01F 27/327* (2013.01); *H01F 17/0013* (2013.01); *H01F 17/04* (2013.01);
(Continued)

(58) Field of Classification Search
CPC ..... H01F 5/00; H01F 27/28
(Continued)

(56) References Cited

U.S. PATENT DOCUMENTS 7,221,250 B2 * 5/2007 Yoshida ..... H01F 27/2804 336/200
7,318,269 B2 * 1/2008 Yoshida ..... G11B 5/1274 29/602.1
(Continued)

FOREIGN PATENT DOCUMENTS

CN 101765893 A 6/2010
JP 05-006832 A 1/1993
(Continued)

OTHER PUBLICATIONS

U.S. Office Action issued in U.S. Appl. No. 14/475,000 dated Jan. 21, 2016.
(Continued)

*Primary Examiner* — Tsz Chan
(74) *Attorney, Agent, or Firm* — McDermott Will & Emery LLP

(57) ABSTRACT

The present application provides a chip electronic component and a manufacturing method thereof. More particularly, there is provided a chip electronic component including a thin insulating film having a reduced width and extended up to a lower portion of a coil pattern without exposing the coil pattern such that the coil pattern has no direct contact with a magnetic material, thereby preventing a poor waveform at high frequency and increasing inductance.

15 Claims, 6 Drawing Sheets

(51) Int. Cl.

| | |
|---|---|
| ***H01F 27/32*** | (2006.01) |
| ***H01F 17/00*** | (2006.01) |
| ***H01F 27/29*** | (2006.01) |
| ***H01F 41/04*** | (2006.01) |
| ***H01F 41/12*** | (2006.01) |
| *H01F 17/04* | (2006.01) |

(52) U.S. Cl.
CPC ..... *H01F 27/292* (2013.01); *H01F 41/042* (2013.01); *H01F 41/046* (2013.01); *H01F 41/127* (2013.01); *H01F 2017/048* (2013.01)

(58) Field of Classification Search
USPC ..... 336/200, 232
See application file for complete search history.

(56) References Cited

U.S. PATENT DOCUMENTS

| | | | | |
|---|---|---|---|---|
| 2002/0101683 | A1* | 8/2002 | Katakura | G11B 5/17 360/123.34 |
| 2010/0127812 | A1 | 5/2010 | Maeda | |
| 2012/0126926 | A1* | 5/2012 | Kroener | H01F 27/2804 336/199 |
| 2013/0234819 | A1 | 9/2013 | Yoo et al. | |

FOREIGN PATENT DOCUMENTS

| | | | | | |
|---|---|---|---|---|---|
| JP | 06036934 | A | * | 2/1994 | |
| JP | 2002-151332 | A | | 5/2002 | |
| JP | 2005-210010 | A | | 8/2005 | |
| JP | 2006278484 | A | * | 10/2006 | |
| JP | 2006-310716 | A | | 11/2006 | |
| JP | 2006310716 | A | * | 11/2006 | |
| JP | 2008-166455 | A | | 7/2008 | |
| JP | 2010-205905 | A | | 9/2010 | |
| JP | 2010205905 | A | * | 9/2010 | |
| KR | 10-2013-0101849 | A | | 9/2013 | |
| WO | 2012093133 | A1 | | 7/2012 | |
| WO | WO 2012093133 | A1 | * | 7/2012 | H01F 27/2804 |

OTHER PUBLICATIONS

U.S. Final Office Action dated Jul. 29, 2016 issued in U.S. Appl. No. 14/475,000.
Korean Office Action dated Jun. 16, 2015, issued in corresponding Korean Patent Application No. 10-2013-0150171 (with English translation).
Chinese Office Action dated Jan. 5, 2017 issued in Chinese Patent Application No. 201410461378 (with English ranslation).
Korean Office Action dated Dec. 16, 2017 issued in Korean Patent Application No. 10-2015-0078503 (with English translation).

* cited by examiner

"A"

"B"

CHIP ELECTRONIC COMPONENT AND MANUFACTURING METHOD THEREOF

CROSS-REFERENCE TO RELATED APPLICATION

This application is a continuation of U.S. patent application Ser. No. 14/475,000 filed on Sep. 2, 2014 which claims the benefit of Korean Patent Application No. 10-2013-0150171 filed on Dec. 4, 2013, with the Korean Intellectual Property Office, the disclosures of which are incorporated herein by reference.

TECHNICAL FIELD

The present disclosure relates to a chip electronic component and a manufacturing method thereof.

BACKGROUND

An inductor, which is one of the chip electronic components, is a representative passive element forming an electronic circuit together with a resistor and a capacitor to remove noise. The inductor is combined with the capacitor using electromagnetic properties to configure a resonance circuit amplifying a signal in a specific frequency band, a filter circuit, or the like.

Recently, as miniaturization and thinness of information technology (IT) devices such as various communications devices, display devices, or the like, have been accelerated, research into a technology for miniaturizing and thinning various elements such as an inductor, a capacitor, a transistor, and the like, used in the IT devices has been continuously conducted. The inductor has also been rapidly replaced by a chip having a small size and a high density and capable of being automatically surface-mounted, and a thin film inductor in which a mixture of magnetic powder and resin is formed on a coil pattern formed on upper and lower surfaces of a thin film insulating substrate by plating has been developed.

In the thin film inductor, after the coil pattern is formed on the insulating substrate, an insulating film is formed thereon so as to prevent a contact between the coil pattern and a magnetic material.

However, in a case in which an insulating body is formed by a lamination method, or the like according to current technology, the insulating film needs to have a sufficient width in order to form the insulating film to be extended up to lower portions of coil portions. As the width of the insulating film becomes large, a volume occupied by the magnetic material is reduced, resulting in a reduction in inductance.

In addition, the insulating film has not been partially formed around the lower portions of the coil portions to thereby create voids. Because the voids in which no insulating film is formed cause the coil portions to directly contact a metal magnetic material, or the like, a leakage current is generated. As a result, inductance has been in a normal state at a frequency of 1 MHz, but has been rapidly reduced at high frequency, thereby creating a poor waveform.

The following Patent Document 1 and Patent Document 2 disclose a thin film inductor in which an internal coil pattern is formed on upper and lower surfaces of an insulating substrate by plating. However, there is a limitation in forming a thin insulating film without any void, by only using the processes disclosed in Patent Document 1 and Patent Document 2.

RELATED ART DOCUMENT (Patent Document 1) Japanese Patent Laid-Open Publication No. 2005-210010

(Patent Document 2) Japanese Patent Laid-Open Publication No. 2008-166455

SUMMARY

An aspect of the present disclosure may provide a chip electronic component including a thin insulating film having a reduced width and extended up to a lower portion of a coil pattern without exposing the coil pattern such that the coil pattern has no direct contact with a magnetic material, thereby preventing a poor waveform at high frequency and increasing inductance, and a manufacturing method thereof.

According to an aspect of the present disclosure, a chip electronic component may include a magnetic body including an insulating substrate. A coil pattern part is formed on at least one surface of the insulating substrate. A thin polymer insulating film coats the coil pattern part. External electrodes are formed on at least one end surface of the magnetic body and connected to the coil pattern part. A shape of a surface of the thin polymer insulating film substantially conforms to a shape of a surface of the coil pattern part.

The thin polymer insulating film may have a thickness of 1 μm to 3 μm.

A region between coil portions of the coil pattern part may be filled with a magnetic material.

The thin polymer insulating film may have a thickness deviation of 1 μm or less.

The thin polymer insulating film may include at least one selected from a group consisting of poly(p-xylylene), an epoxy resin, a polyimide resin, a phenoxy resin, a polysulfone resin, and a polycarbonate resin.

According to another aspect of the present disclosure, a chip electronic component may include a magnetic body including an insulating substrate. A coil pattern part is formed on at least one surface of the insulating substrate. A thin polymer insulating film coats the coil pattern part. External electrodes are formed on at least one end surface of the magnetic body and connected to the coil pattern part. The thin polymer insulating film may have a thickness of 3 μm or less.

The thin polymer insulating film may have a thickness of 1 μm to 3 μm.

A region between coil portions of the coil pattern part may be filled with a magnetic material.

The thin polymer insulating film may be formed on a surface of the coil pattern part while corresponding to a shape of the coil pattern part.

The thin polymer insulating film may have a thickness deviation of 1 μm or less.

The thin polymer insulating film may include at least one selected from a group consisting of poly(p-xylylene), an epoxy resin, a polyimide resin, a phenoxy resin, a polysulfone resin, and a polycarbonate resin.

According to another aspect of the present disclosure, a chip electronic component may include a magnetic body including an insulating substrate. A coil pattern part is formed on at least one surface of the insulating substrate. A thin polymer insulating film coats the coil pattern part.

External electrodes are formed on at least one end surface of the magnetic body and connected to the coil pattern part. A region between coil portions of the coil pattern part is coated with the thin polymer insulating film and may be filled with a magnetic material.

The thin polymer insulating film may have a thickness of 1 μm to 3 μm.

A distance between the coil portions of the coil pattern part may be 3 μm to 15 μm.

The thin polymer insulating film may be formed on a surface of the coil pattern part while corresponding to a shape of the coil pattern part.

The thin polymer insulating film may have a thickness deviation of 1 μm or less.

The thin polymer insulating film may include at least one selected from a group consisting of poly(p-xylylene), an epoxy resin, a polyimide resin, a phenoxy resin, a polysulfone resin, and a polycarbonate resin.

According to another aspect of the present disclosure, a method of manufacturing a chip electronic component is provided. The method includes forming a coil pattern part on at least one surface of an insulating substrate. A thin polymer insulating film coating the coil pattern part is formed. A magnetic body is formed by stacking magnetic layers on and below the insulating substrate having the coil pattern part formed thereon. External electrodes are formed on at least one end surface of the magnetic body to be connected to the coil pattern part. A shape of a surface of the thin polymer insulating film substantially conforms to a shape of a surface of the coil pattern part.

The thin polymer insulating film may be formed by a chemical vapor deposition (CVD).

The thin polymer insulating film may be formed by using a compound in which a dimer is present in a gas phase at 120° C. to 180° C. and is pyrolyzed into a monomer at 650° C. to 700° C.

The thin polymer insulating film may be formed to have a thickness of 1 μm to 3 μm.

The thin polymer insulating film may be formed to have a thickness deviation of 1 μm or less.

In the forming of the magnetic body, a region between coil portions of the coil pattern part coated with the thin polymer insulating film may be filled with a magnetic material.

Additional advantages and novel features will be set forth in part in the description which follows, and in part will become apparent to those skilled in the art upon examination of the following and the accompanying drawings or may be learned by production or operation of the examples. The advantages of the present teachings may be realized and attained by practice or use of various aspects of the methodologies, instrumentalities and combinations set forth in the detailed examples discussed below.

BRIEF DESCRIPTION OF THE DRAWINGS

The above and other aspects, features and other advantages of the present disclosure will be more clearly understood from the following detailed description taken in conjunction with the accompanying drawings, in which.

DETAILED DESCRIPTION

Figure 1:
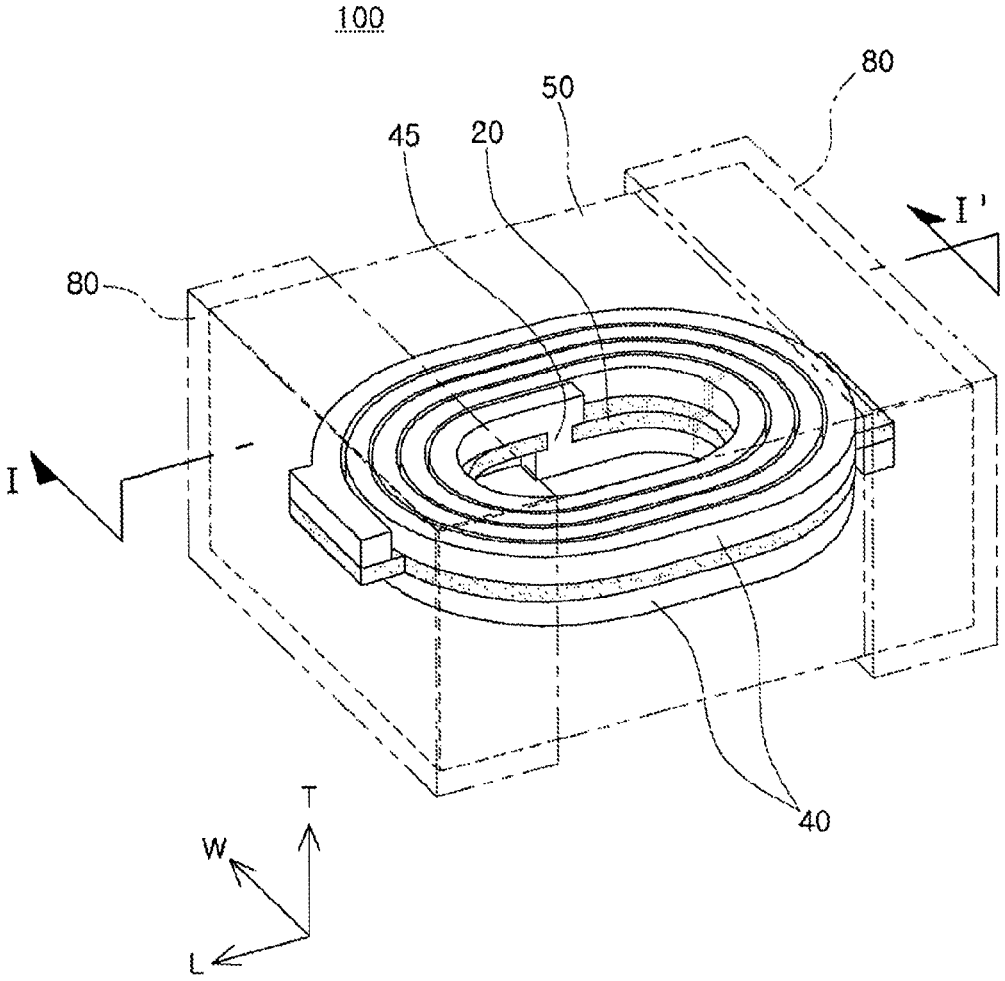
FIG. 1 is a perspective view illustrating a coil pattern part disposed within a chip electronic component according to an exemplary embodiment of the present disclosure.

Exemplary embodiments of the present disclosure will now be described in detail with reference to the accompanying drawings.

The disclosure may, however, be embodied in many different forms and should not be construed as being limited to the embodiments set forth herein. Rather, these embodiments are provided so that this disclosure will be thorough and complete, and will fully convey the scope of the disclosure to those skilled in the art.

In the drawings, the shapes and dimensions of elements may be exaggerated for clarity, and the same reference numerals will be used throughout to designate the same or like elements.

Chip Electronic Component

Hereinafter, a chip electronic component according to an exemplary embodiment of the present disclosure, particularly, a thin film inductor will be described. However, the present disclosure is not limited thereto.

Figure 2:
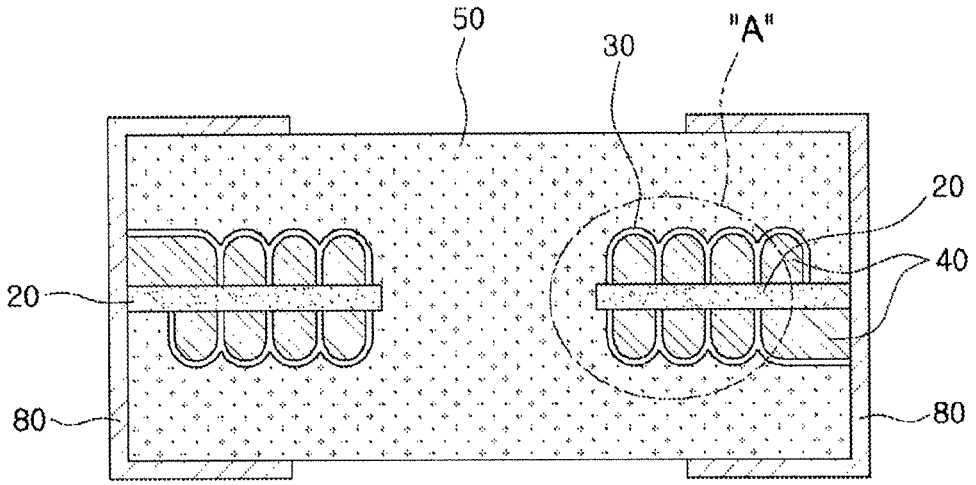
FIG. 2 is a cross-sectional view taken along line I-I' of FIG. 1.
Figure 3:
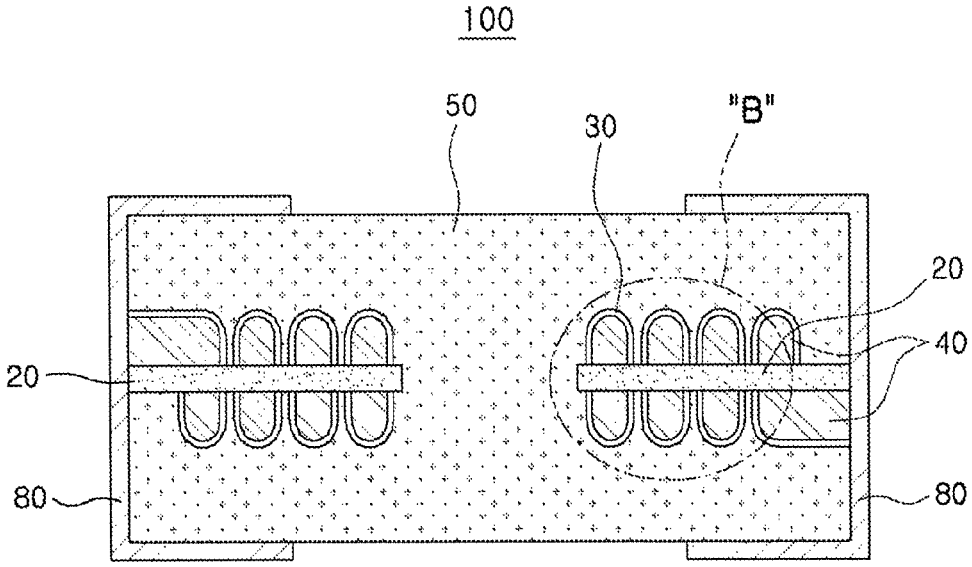
FIG. 3 is a cross-sectional view taken along line I-I' of FIG. 1 according to another exemplary embodiment of the present disclosure.

FIG. 1 is a perspective view illustrating a coil pattern part disposed within a chip electronic component according to an exemplary embodiment of the present disclosure, and FIG. 2 is a cross-sectional view taken along line I-I' of FIG. 1. FIG. 3 is a cross-sectional view taken along line I-I' of FIG. 1 according to another exemplary embodiment of the present disclosure.

Referring to FIGS. 1 through 3, a thin film inductor 100 used in a power line of a power supply circuit is disclosed as an example of a chip electronic component. A chip bead, a chip filter, and the like, as well as the chip inductor may be appropriately used as the chip electronic component.

The thin film inductor 100 may include a magnetic body 50, an insulating substrate 20, an internal coil pattern part 40, and external electrodes 80.

The magnetic body 50 may form an exterior appearance of the thin film inductor 100, and may be formed of any material without limitation as long as the material may exhibit magnetic properties. For example, the magnetic body 50 may be formed by filling an inner space with a ferrite or a metal-based soft magnetic material. Examples of the ferrite may include Mn—Zn based ferrite, Ni—Zn based ferrite, Ni—Zn—Cu based ferrite, Mn—Mg based ferrite, Ba based ferrite, Li based ferrite, or the like, and an example of the metal-based soft magnetic material may include a Fe—Si—B—Cr based amorphous metal powder. However, the material of the magnetic body 50 is not limited thereto.

The magnetic body 50 may have a hexahedral shape. Directions of a hexahedron will be defined in order to clearly describe an exemplary embodiment of the present disclosure. L, W and T of a hexahedron shown in FIG. 1 refer to a length direction, a width direction, and a thickness direction, respectively. The magnetic body 50 may have a rectangular parallelepiped shape.

The insulating substrate 20 formed in the magnetic body 50 may be formed of a thin film. For example, a printed circuit board (PCB), a ferrite substrate, a metal based soft magnetic substrate, or the like may be used therefor.

The insulating substrate 20 may have a through hole formed in a central portion thereof, wherein the through hole may be filled with a magnetic material such as ferrite, a metal based soft magnetic material, or the like, to form a core part. The core part may be filled with the magnetic material, thereby increasing inductance L.

The coil pattern part 40 may be formed on one surface and the other surface of the insulating substrate 20, respectively, wherein the coil pattern part 40 may have a coil-shaped pattern.

The coil pattern part 40 may include a spiral-shaped coil pattern, and the coil pattern part 40 formed on one surface of the insulating substrate 20 may be electrically connected to that formed on the other surface of the insulating substrate 20 through a via electrode 45 (FIG. 1) formed in the insulating substrate 20.

The coil pattern part 40 and the via electrodes 45 may include a metal having excellent electrical conductivity, such as silver (Ag), palladium (Pd), aluminum (Al), nickel (Ni), titanium (Ti), gold (Au), copper (Cu), platinum (Pt), an alloy thereof, or the like.

A thin polymer insulating film 30 may be formed on a surface of the coil pattern part 40, thereby coating the coil pattern part 40.

A surface of the thin polymer insulating film 30 may correspond to a shape of surface of the coil pattern part 40. As shown in FIGS. 2 and 3, the polymer insulating film 30 is thinly coated on the surface of the coil pattern part 40 while corresponding to the shape of surface of the coil pattern part 40.

The thin polymer insulating film 30 may be extended up to lower portions of coil portions while corresponding to the shape of the coil pattern part 40, thereby preventing a portion of the coil pattern part 40 from being exposed and preventing a leakage current and a poor waveform.

The thin polymer insulating film 30 according to the exemplary embodiment of the present disclosure may be formed by a chemical vapor deposition (CVD) or a dipping method using a polymer coating solution having low viscosity.

The thin polymer insulating film 30 may have a thickness of 3 μm or less, and more preferably, a thickness of 1 μm to 3 μm.

When the thickness of the thin polymer insulating film 30 is less than 1 μm, the insulating film may be damaged during stacking and compressing the magnetic layers, resulting in a poor waveform due to contact between the coil pattern part 40 and a magnetic material. When the thickness of the thin polymer insulating film 30 is greater than 3 μm, a volume occupied by the magnetic material within the magnetic body may be reduced as much as an increased thickness of the insulating film, resulting in a limitation in increasing inductance.

The thickness of the thin polymer insulating film 30 may be uniform with a thickness deviation of 1 μm or less. The thickness deviation refers to a difference between the thickest portion and the thinnest portion of the thin polymer insulating film 30 coated on the respective coil patterns, by observing a cross-section of the coil pattern part 40.

When the thickness deviation of the thin polymer insulating film 30 is greater than 1 μm, the insulating film may be damaged or the portion of the coil pattern part 40 may be exposed during the stacking and compressing of the magnetic layers, resulting in a poor waveform due to contact between the coil pattern part 40 and the magnetic material.

The thin polymer insulating film 30 may include poly(p-xylylene), an epoxy resin, a polyimide resin, a phenoxy resin, a polysulfone resin, a polycarbonate resin, or a mixture thereof, but is not limited thereto.

Figure 4:
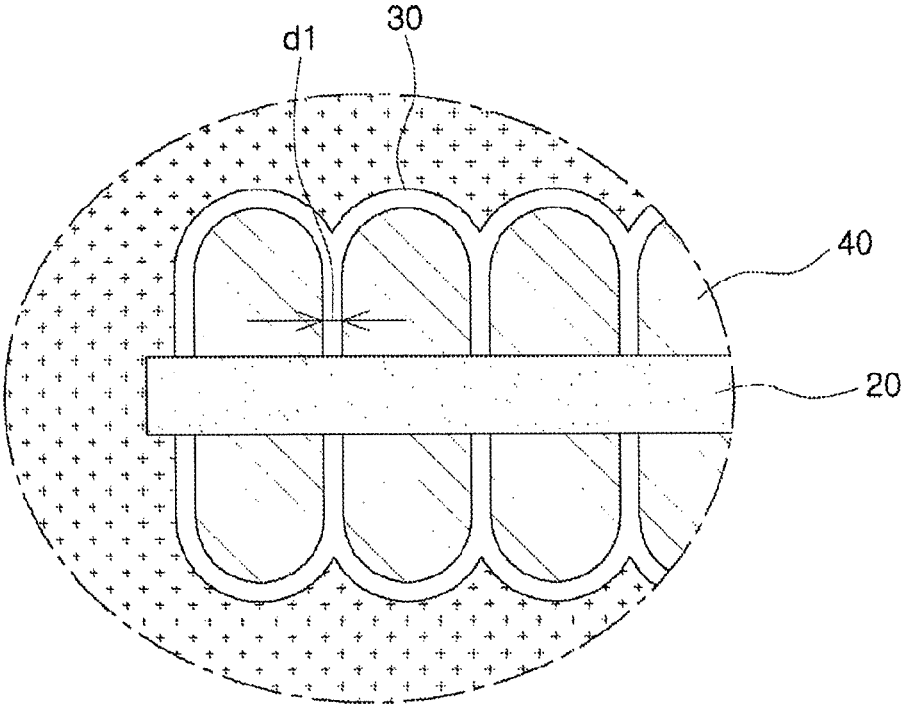
FIG. 4 is an enlarged view of part A of FIG. 2.
Figure 5:
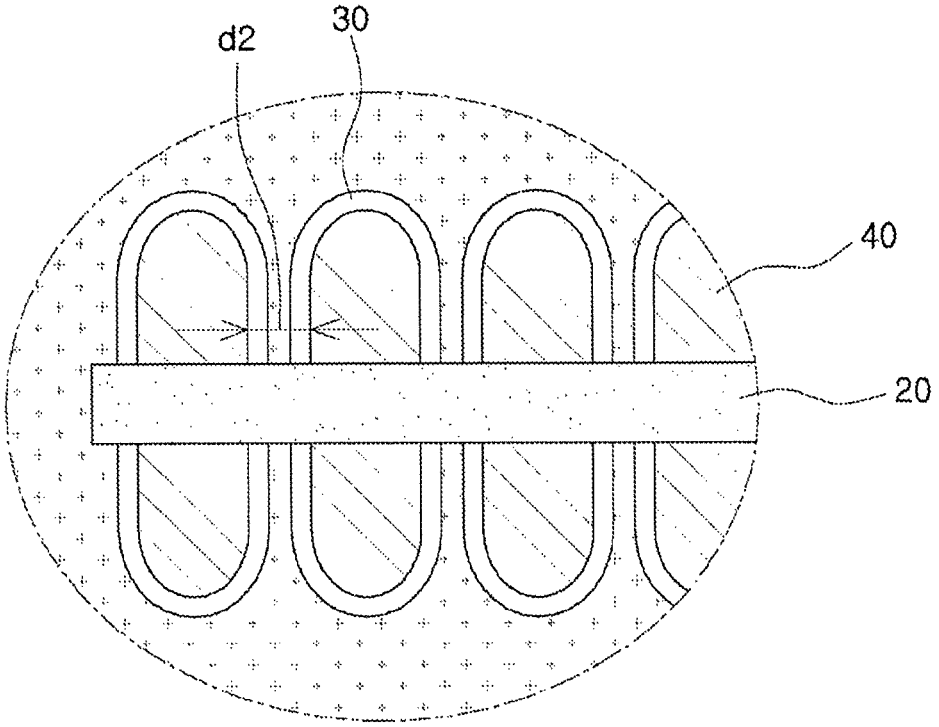
FIG. 5 is an enlarged view of part B of FIG. 3.

FIG. 4 is an enlarged view of part A of FIG. 2, and FIG. 5 is an enlarged view of part B of FIG. 3.

Referring to FIG. 4, only the thin polymer insulating film 30 may be formed in a region between the coil portions of the coil pattern part 40. When a distance d1 between the coil portions of the coil pattern part 40 is short, only the thin polymer insulating film 30 may be formed in the region between the coil portions.

Meanwhile, referring to FIG. 5, the region between the coil portions of the coil pattern part 40 may be filled with the magnetic material.

Because the polymer insulating film 30 is thinly formed while corresponding to the shape of the coil pattern part 40, a space may be formed in the region between the coil portions. The space is filled with the magnetic material, such that the volume occupied by the magnetic material is increased, whereby inductance may be increased as much as the increased volume of the magnetic material.

Because the thin polymer insulating film 30 is uniformly formed on the surface of the coil pattern part 40 to be extended up to the lower portions of the coil portions, a poor waveform, or the like caused by the magnetic material filling the region between the coil portions may be prevented, and inductance may be increased.

In the case of the structure in which the region between the coil portions of the coil pattern part 40 is filled with the magnetic material according to this exemplary embodiment of the present disclosure, a distance d2 between the coil portions of the coil pattern part 40 may be 3 μm to 15 μm and a particle diameter of the magnetic material may be 0.1 μm to 15 μm.

Figure 6:
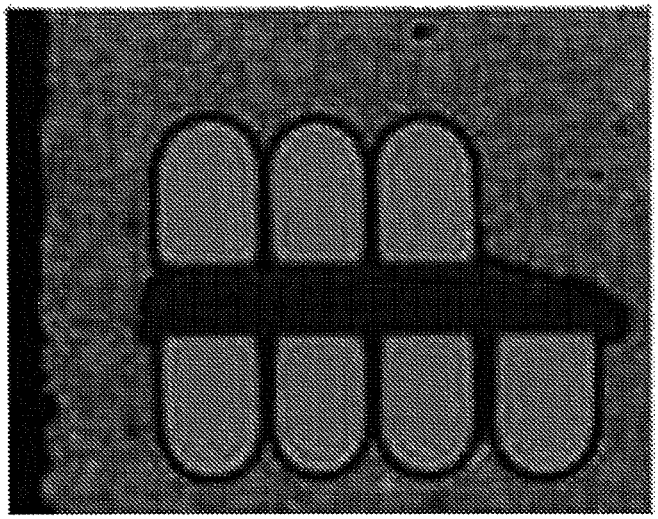
FIG. 6 is an enlarged scanning electron microscope (SEM) photograph of a coil pattern part having a thin polymer insulating film in a chip electronic component according to an exemplary embodiment of the present disclosure.

FIG. 6 is an enlarged scanning electron microscope (SEM) photograph of a coil pattern part having a thin polymer insulating film in a chip electronic component according to an exemplary embodiment of the present disclosure.

Referring to FIG. 6, the polymer insulating film 30 is thinly formed on the surface of the coil pattern part 40 while corresponding to the shape of the coil pattern part 40. Although FIG. 6 shows the structure in which only the thin polymer insulating film 30 is formed in the space between the coil portions, the magnetic material may also be provided in the space between the coil portions in a case in which a distance between the coil portions is increased.

One end of the coil pattern part 40 formed on one surface of the insulating substrate 20 may be exposed to one end surface of the magnetic body 50 in the length direction thereof, and the other end of the coil pattern part 40 formed on the other surface of the insulating substrate 20 may be exposed to the other end surface of the magnetic body 50 in the length direction thereof.

The external electrodes 80 may be formed on both end surfaces of the magnetic body 50 in the length direction thereof, respectively, so as to be connected to the ends of the coil pattern part 40 exposed to the end surfaces of the magnetic body 50. The external electrodes 80 may be extended to both end surfaces of the magnetic body 50 in the thickness direction thereof and/or both end surfaces of the magnetic body 50 in the width direction thereof.

The external electrodes 80 may be formed of a metal having excellent electrical conductivity. For example, nickel (Ni), copper (Cu), tin (Sn), or silver (Ag), or an alloy thereof may be used therefor.

Method of Manufacturing Chip Electronic Component

Figure 7:
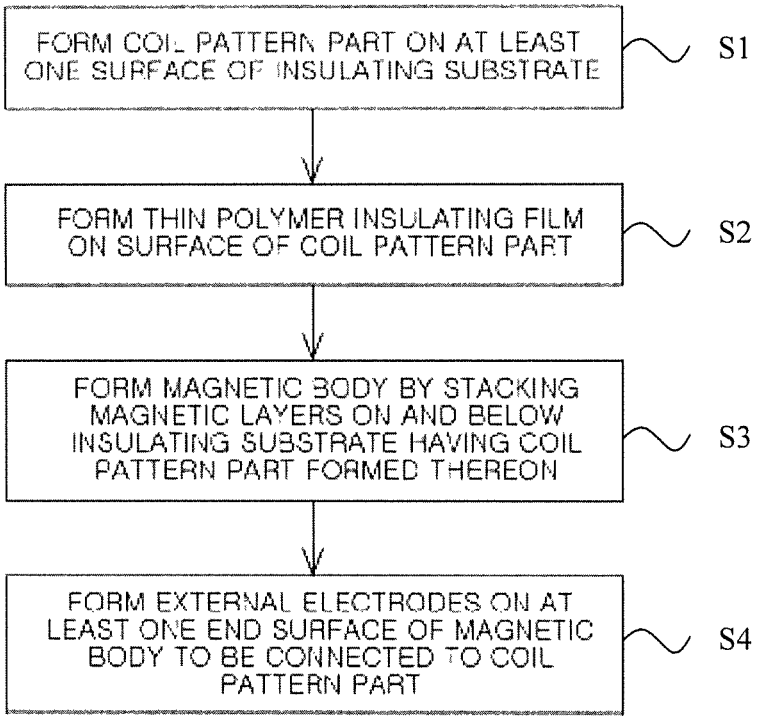
FIG. 7 is a flowchart illustrating a method of manufacturing a chip electronic component according to an exemplary embodiment of the present disclosure.

FIG. 7 is a flowchart illustrating a method of manufacturing a chip electronic component according to an exemplary embodiment of the present disclosure.

Referring to FIG. 7, first, the coil pattern part 40 may be formed on at least one surface of the insulating substrate 20 (S1).

The insulating substrate 20 is not particularly limited. For example, a printed circuit board (PCB), a ferrite substrate, a metal based soft magnetic substrate, or the like, may be used as the insulating substrate 20, and the insulating substrate 20 may have a thickness of 40 μm to 100 μm.

A method of forming the coil pattern part 40 may be, for example, an electroplating method, but is not limited thereto. The coil pattern part 40 may be formed of a metal having excellent electrical conductivity, such as silver (Ag), palladium (Pd), aluminum (Al), nickel (Ni), titanium (Ti), gold (Au), copper (Cu), platinum (Pt), an alloy thereof, or the like.

The via electrodes 45 may be formed by forming holes in portions of the insulating substrate 20 and filling the holes with a conductive material, and the coil pattern part 40 formed on one surface of the insulation layer 20 may be electrically connected to that formed on the other surface of the insulation layer 20 through the via electrodes 45.

The hole may be formed in a central portion of the insulating substrate 20 by performing a drilling process, a laser process, a sand blast process, or a punching process, or the like.

Next, the thin polymer insulating film 30 may be formed on the surface of the coil pattern part 40 (S2).

The thin polymer insulating film 30 may be formed by a chemical vapor deposition (CVD) or a dipping method using a polymer coating solution having low viscosity.

As the thin polymer insulating film 30 is formed by the chemical vapor deposition (CVD) or the dipping method using the polymer coating solution having low viscosity, the polymer insulating film 30 may be thinly formed on the surface of the coil pattern part 40 while corresponding to the shape of the surface of the coil pattern part 40, and the thin polymer insulating film 30 may be extended up to the lower portions of the coil portions, thereby preventing the coil pattern part 40 from being exposed and preventing a leakage current and a poor waveform.

When the chemical vapor deposition (CVD) is used, the thin polymer insulating film 30 may be formed by using a compound in which a dimer is present in gas phase at 120° C. to 180° C. and is pyrolyzed into a monomer at 650° C. to 700° C. For example, poly(p-xylylene) may be used.

A polymer used in a low viscosity dipping method is not particularly limited as long as it may form the thin insulating film. For example, the polymer may include an epoxy resin, a polyimide resin, a phenoxy resin, a polysulfone resin, a polycarbonate resin, or a mixture thereof.

The thin polymer insulating film 30 may be formed to have a thickness of 3 μm or less, and more preferably, a thickness of 1 μm to 3 μm.

When the thickness of the thin polymer insulating film 30 is less than 1 μm, the insulating film may be damaged during stacking and compressing magnetic layers, resulting in a poor waveform due to contact between the coil pattern part 40 and the magnetic material. When the thickness of the thin polymer insulating film 30 is greater than 3 μm, a volume occupied by the magnetic material may be reduced as much as an increased thickness of the insulating film, resulting in a limitation in increasing inductance.

The thickness of the thin polymer insulating film 30 may be uniform with a thickness deviation of 1 μm or less.

When the thickness deviation of the thin polymer insulating film 30 is greater than 1 μm, the insulating film may be damaged or the portions of the coil pattern part 40 may be exposed during the stacking and compressing of the magnetic layers, resulting in a poor waveform due to contact between the coil pattern part 40 and the magnetic material.

Next, magnetic layers may be stacked on and below the insulating substrate 20 having the coil pattern part 40 formed thereon, thereby forming the magnetic body 50 (S3).

The magnetic body 50 may be formed by stacking both surfaces of the insulation substrate 20 and pressing the stacked magnetic layers by a laminating method or isostatic pressing method.

Here, the hole may be filled with the magnetic material, thereby forming a core part.

The region between the coil portions of the coil pattern part 40 may also be filled with the magnetic material.

Because the polymer insulating film 30 is thinly formed on the surface of the coil pattern part 40 while corresponding to the shape of the coil pattern part 40, a space may be formed in the region between the coil portions. The space may be filled with the magnetic material during the stacking and compressing of the magnetic layers. The region between the coil portions of the coil pattern part 40 may also be filled with the magnetic material, such that the volume occupied by the magnetic material may be increased, whereby inductance may be increased as much as the increased volume of the magnetic material.

Because the thin polymer insulating film 30 is uniformly formed to be extended up to the lower portions of the coil portions while corresponding to the surface of the coil pattern part 40, a poor waveform, or the like caused by the magnetic material filling the region between the coil portions may be prevented and inductance may be increased.

Next, the external electrodes 80 may be formed on at least one end surface of the magnetic body 50 to be connected to the coil pattern part 40 exposed thereto (S4).

The external electrodes 80 may be formed using a conductive paste containing a metal having excellent electric conductivity, wherein the conductive paste may include, for example, nickel (Ni), copper (Cu), tin (Sn), and silver (Ag) or an alloy thereof. The external electrodes 80 may be formed by performing a dipping method, or the like, as well as a printing method according to the shape of the external electrodes 80.

A redundant description of the same features as those of the chip electronic component according to the above-described exemplary embodiment of the present disclosure will be omitted.

As set forth above, according to exemplary embodiments of the present disclosure, a chip electronic component includes a thin insulating film having a reduced width and extended up to a lower portion of a coil pattern without exposing the coil pattern such that the coil pattern has no direct contact with a magnetic material, thereby preventing a poor waveform at high frequency and increasing inductance, and a manufacturing method thereof.

While exemplary embodiments have been shown and described above, it will be apparent to those skilled in the art that modifications and variations could be made without departing from the spirit and scope of the present disclosure as defined by the appended claims.

What is claimed is:

1. A chip electronic component, comprising:

a magnetic body including an insulating substrate;

a coil pattern part disposed on at least one surface of the insulating substrate;

a thin polymer insulating film including vertical portions coated, from the insulating substrate, on side surfaces of the coil pattern part and each having a thickness of 1 μm to 3 μm, and a top portion connecting the vertical portions, having a thickness of 1 μm to 3 μm, and coated on top surface of the coil pattern part connecting the side surfaces of the coil pattern part;

a magnetic material of the magnetic body filling space between vertical portions of the thin polymer insulating film and embedding the coil pattern part; and external electrodes disposed on at least one end surface of the magnetic body and connected to the coil pattern part, wherein a shape of a surface of the thin polymer insulating film substantially conforms to a shape of a surface of the coil pattern part.

2. The chip electronic component of claim 1, wherein the thin polymer insulating film has a thickness deviation, defined to be a difference between the thickest portion and the thinnest portion of the thin polymer insulating film coated on the respective coil patterns, of 1 μm or less.

3. The chip electronic component of claim 1, wherein the thin polymer insulating film includes at least one selected from a group consisting of: poly(p-xylylene), an epoxy resin, a polyimide resin, a phenoxy resin, a polysulfone resin, and a polycarbonate resin.

4. The chip electronic component of claim 1, wherein a cross-section of the coil pattern part cut along a plane perpendicular to a path along which the coil pattern extends has a convex end, and a portion of the thin polymer insulating film has a convex shape and has a height with respect to the insulating substrate first increasing from an edge of the cross-section to a center of the cross-section and then decreasing from the center of the cross-section to another edge of the cross-section.

5. The chip electronic component of claim 1, wherein the magnetic body includes Fe-based amorphous metal powder.

6. A chip electronic component, comprising:

a magnetic body including an insulating substrate;

a coil pattern part formed on at least one surface of the insulating substrate, the coil pattern part including a plurality of coil portions;

a thin polymer insulating film including vertical portions coated, from the insulating substrate, on side surfaces of the coil pattern part and each having a thickness of 1 μm to 3 μm, and a top portion connecting the vertical portions, having a thickness of 1 μm to 3 μm, and coated on top surface of the coil pattern part connecting the side surfaces of the coil pattern part; and external electrodes formed on at least one end surface of the magnetic body and connected to the coil pattern part, wherein, a cross-section of the coil pattern part cut along a plane perpendicular to a path along which the coil pattern part extends has a convex end, a portion of the thin polymer insulating film has a convex shape and has a height with respect to the insulating substrate first increasing from an edge of the cross-section to a center of the cross-section and then decreasing from the center of the cross-section to another edge of the cross-section, and a shape of a surface of the thin polymer insulation film substantially conforms to a shape of a surface of the coil pattern part.

7. The chip electronic component of claim 6, wherein only the thin polymer insulating film is formed in a region between the coil portions of the coil pattern part.

8. The chip electronic component of claim 6, wherein:

a region between coil portions of the coil pattern part is filled with a magnetic material such that a distance between the coil portions of the coil pattern part is 3 μm to 15 μm.

9. The chip electronic component of claim 6, wherein the thin polymer insulating film has a thickness deviation, defined to be a difference between the thickest portion and the thinnest portion of the thin polymer insulating film coated on the respective coil patterns, of 1 μm or less.

10. The chip electronic component of claim 6, wherein the thin polymer insulating film includes at least one selected from a group consisting of: poly(p-xylylene), an epoxy resin, a polyimide resin, a phenoxy resin, a polysulfone resin, and a polycarbonate resin.

11. The chip electronic component of claim 6, wherein the magnetic body includes Fe-based amorphous metal powder.

12. A chip electronic component, comprising:

a magnetic body including an insulating substrate and including Fe-based amorphous metal powder;

a coil pattern part formed on at least one surface of the insulating substrate;

a thin polymer insulating film including vertical portions coated, from the insulating substrate, on side surfaces of the coil pattern part and each having a thickness of 1 μm to 3 μm, and a top portion connecting the vertical portions, having a thickness of 1 μm to 3 μm, and coated on top surface of the coil pattern part connecting the side surfaces of the coil pattern part; and external electrodes formed on at least one end surface of the magnetic body and connected to the coil pattern part, wherein a region between coil portions of the coil pattern part coated with the thin polymer insulating film is filled with a magnetic material, and a shape of a surface of the thin polymer insulation film substantially conforms to a shape of a surface of the coil pattern part.

13. The chip electronic component of claim 12, wherein a distance between the coil portions of the coil pattern part is 3 μm to 15 μm.

14. The chip electronic component of claim 12, wherein the thin polymer insulating film has a thickness deviation, defined to be a difference between the thickest portion and the thinnest portion of the thin polymer insulating film coated on the respective coil patterns, of 1 μm or less.

15. The chip electronic component of claim 12, wherein the thin polymer insulating film includes at least one selected from a group consisting of: poly(p-xylylene), an epoxy resin, a polyimide resin, a phenoxy resin, a polysulfone resin, and a polycarbonate resin.

* * * * *